United States Patent [19]

Bunnell

[11] Patent Number: 4,508,415

[45] Date of Patent: Apr. 2, 1985

[54] SHIELDED ELECTRICAL CONNECTOR FOR FLAT CABLE

[75] Inventor: Edward D. Bunnell, Palm Harbor, Fla.

[73] Assignee: AMP Incorporated, Harrisburg, Pa.

[21] Appl. No.: 518,503

[22] Filed: Jul. 29, 1983

[51] Int. Cl.[3] ..... H01R 13/648

[52] U.S. Cl. ..... 339/143 R; 339/17 F; 339/176 MF

[58] Field of Search ..... 339/14 R, 14 L, 17 F, 339/143 R, 107, 176 MF

[56] References Cited

U.S. PATENT DOCUMENTS 4,449,778 5/1984 Lane ..... 339/143 R

*Primary Examiner*—Eugene F. Desmond

*Attorney, Agent, or Firm*—F. Brice Faller; Russell J. Egan

[57] ABSTRACT

Shielded electrical connector for flat cable with shielded signal conductors and drain wires has terminal housing with terminals for signal conductors sandwiched between connector shield members. Bottom shield member has upstanding flange flanked by coplanar tabs; flange contacts exposed cable shield and tabs have slots for terminating drain wires. Top shield member has upstanding flange which contacts exposed shield opposite flange on bottom member and upstanding tabs flanking the flange in parallel planes perpendicular to the plane of said tabs on said bottom member. Tabs on top member flex inward against tabs on bottom member until inward facing detents on bottom tabs latch into apertures in top tabs.

4 Claims, 9 Drawing Figures

SHIELDED ELECTRICAL CONNECTOR FOR FLAT CABLE

BACKGROUND OF THE INVENTION

The present invention relates to a shielded electrical connector for flat cable.

The need for shielding communications cable to prevent interference with signals carried by the cable is well recognized. Such cables are usually shielded by a braid or by foil around one or more insulated conductors; the shield is often followed by a drain wire which facilitates grounding the shield at termination points. Recently there has been an increased requirement for shielded electrical connectors to eliminate breaks in shielding continuity at cable termination and connection points. U.S. patent application Ser. No. 452,171, hereby incorporated by reference, discloses such a connector directed to terminating a braided round cable.

Flat multiconductor cable, including shielded flat multiconductor cable developed in recent years, has proven quite useful since the close control of conductor spacing facilitates mass termination. Flat cable is also useful for routing under carpets and other places where a low profile is required.

SUMMARY

The present invention is directed to a shielded connector for flat cable with two pairs of foil shielded signal conductors and a drain wire for each shield. The connector comprises a terminal housing which holds terminals for the signal wires in the cable and top and bottom shield members which fit against the terminal housing. The shield members are stamped and formed from metal and have serrated flanges which grip the foil shield where external insulation has been stripped away, and latches on either side of the flanges. The latches on the bottom member are coplanar with the flange and incorporate slots for terminating the drain wires, while the latches on the top member are perpendicular to the flange and cooperate with the bottom latches to firmly grip the cable between the flanges. The two shield members thus provide grounding for the drain wires as well as the foil shield, and further latch together to firmly grip the cable.

DETAILED DESCRIPTION OF THE PREFERRED EMBODIMENT

Figure 1:
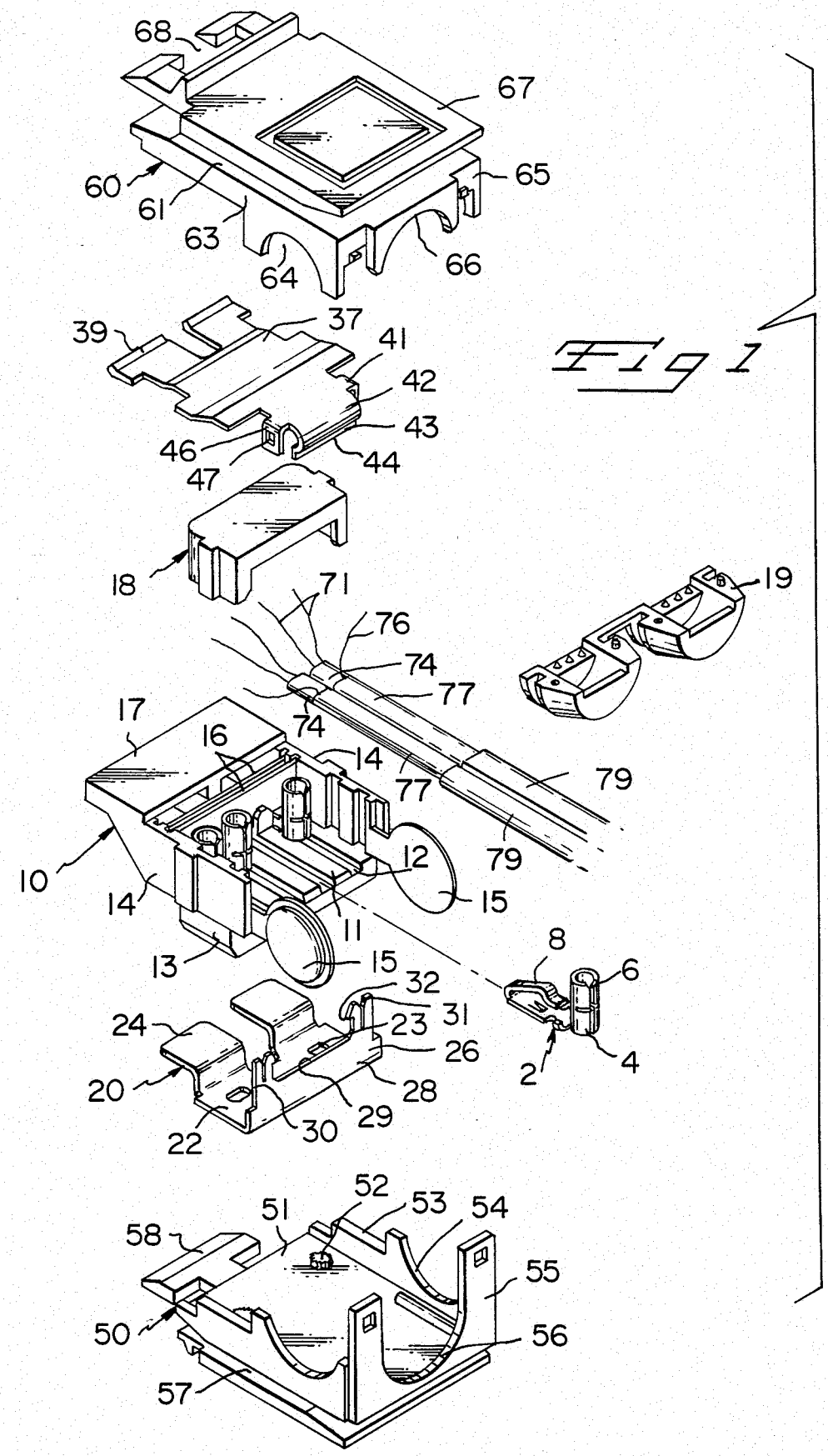
FIG. 1 is an exploded perspective of the connector.

Each connector is of identical hermaphroditic construction and comprises a terminal housing 10, a wire stuffer 18, a strain relief bushing 19, a bottom shield member 20, a top shield member 35, a bottom cover 50, and a top cover 60. The terminal housing 10 comprises a platform 10 with channels 12 profiled to receive terminals 2. Each terminal 2 has a wire receiving slot 6 in a barrel 4 and a contact tongue 8. Shorting bars 16 are received between sidewalls 14 which are bridged at one end by hood 17 and have frangible plugs 15 extending from the other end. Other details of the housing 10 and terminals 2 are as described in U.S. application Ser. No. 452,171. The cable 70 has been stripped as will be described in FIG. 2A et seq to expose signal conductors 71, foil shield 74, and drain wires 76. The external insulation 77 is received in strain relief bushing 19, which is folded onto the cable.

Referring still to FIG. 1, bottom shield member 20 is stamped and formed from a single piece of sheet metal such as brass and comprises a panel 22 with retaining holes 23 therein, a contact portion 24, and an opposed cable connecting portion 26. The cable connecting portion 26 comprises a flange 28 formed substantially perpendicular to the panel 22 and a pair of coplanar tabs 30 upstanding from edge 29 of the flange 28. Each tab 30 has a slot 31 extending toward panel 22 and a detent 32 formed on the edge thereof facing the other tab 30. Top shield member 35 likewise comprises a panel 37, a contact portion 39, and a cable connecting portion 41. The cable connecting portion 41 comprises a reverse bend 42 with a flange 43 having edge 44. Tabs 46 upstanding from panel 37 adjacent flange 43 each have an aperture 47. The tabs 46 are parallel to each other and substantially perpendicular to panel 37 and flange 43.

Bottom cover 50 has a base 51 with studs thereon which are received in holes 23 in bottom shield member 20, which is trapped between base 51 and foot 13 on housing 10. Base 51 is flanked by sidewalls 53 having recesses 54 profiled to receive blanks 54 and a rear wall 55 with a recess 56 profiled to receive bushing 19. A latch arm 57 has an integral T-bar 58 profiled for mating in T-slot 68 in latch arm 67 of top cover 60 of a like connector. The top cover 60 further comprises a base 61 flanked by sidewalls 63 having recesses 64 and a rear wall 65 with a recess 66.

Figure 2:
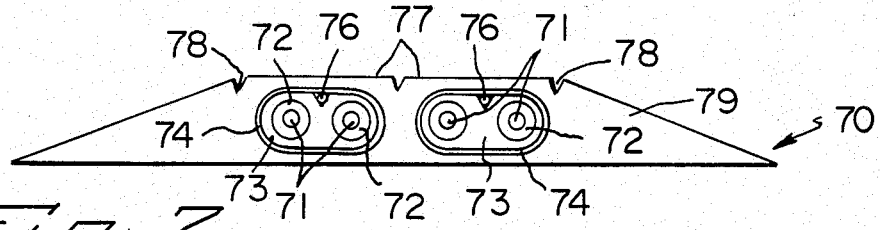
FIG. 2 is a cross section of the cable.

FIG. 2 is a cross section of the flat cable 70 for which the preferred embodiment of shielded connector is most suited. Each pair of signal conductors 71 in polyolefin foam insulation 72 is contained in extruded PVC jacket 73 surrounded by a foil shield 74. The cigarette-wrapped shield 74 is 0.001 inch aluminum on the inside and 0.001 inch polyester on the outside, and lies against a drain wire 76 in a groove in the jacket 73. An external PVC jacket 77 extruded about the two pairs of shielded signal conductors 71 includes sloped side wings 79 for undercarpet application and V-grooves 78 to facilitate separation of the pairs from each other or the wings 79.

Figure 3A:
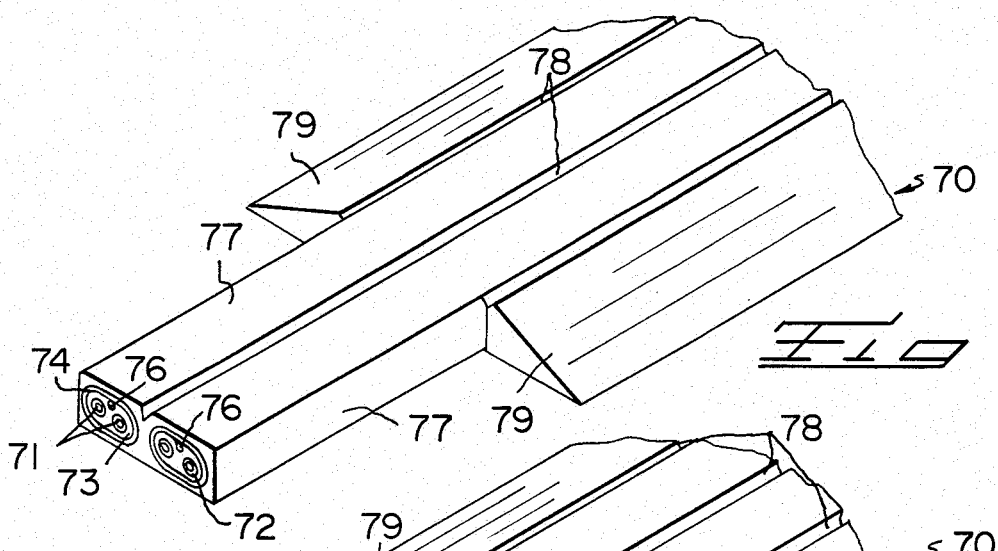
FIGS. 3A, 3B, and 3C are perspectives showing the cable strippiing sequence.
Figure 3B:
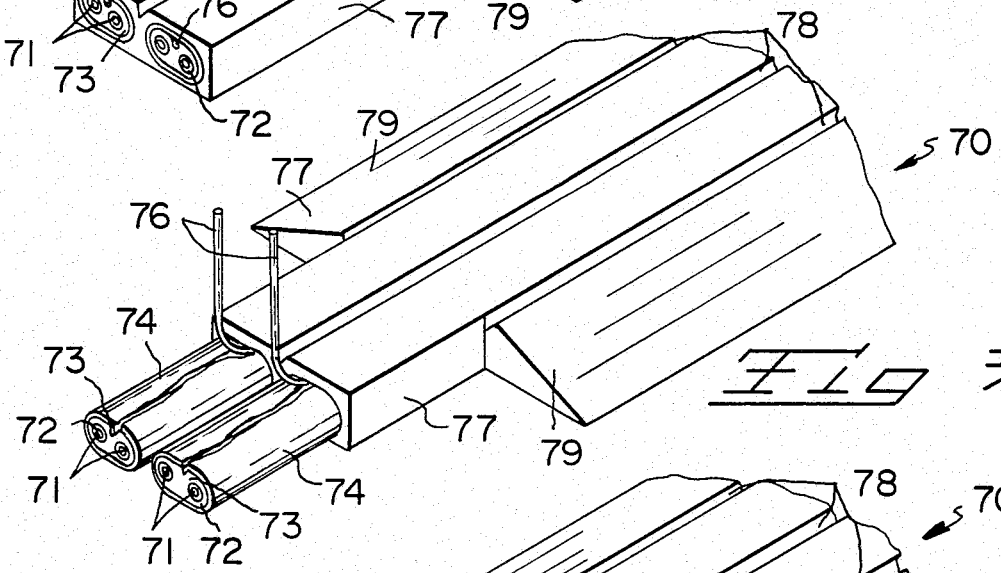
Figure 3C:
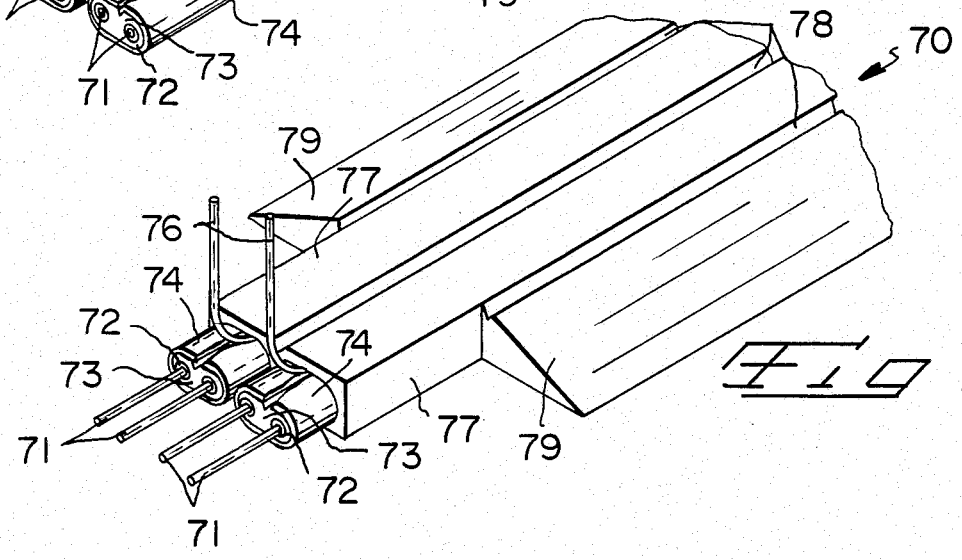

FIG. 3A illustrates the first step in preparing the cable 70 for termination, which is removal of the side wings 79 for a distance from the end to be terminated. Next the external insulation 77 is stripped to expose the shields 74 and the drain wires 76 are pulled through the respective foil shields 74, as shown in FIG. 3B. Next the individual signal wire insulation 72, internal jackets 73, and shields 74 are stripped as shown in FIG. 3C.

Figure 4A:
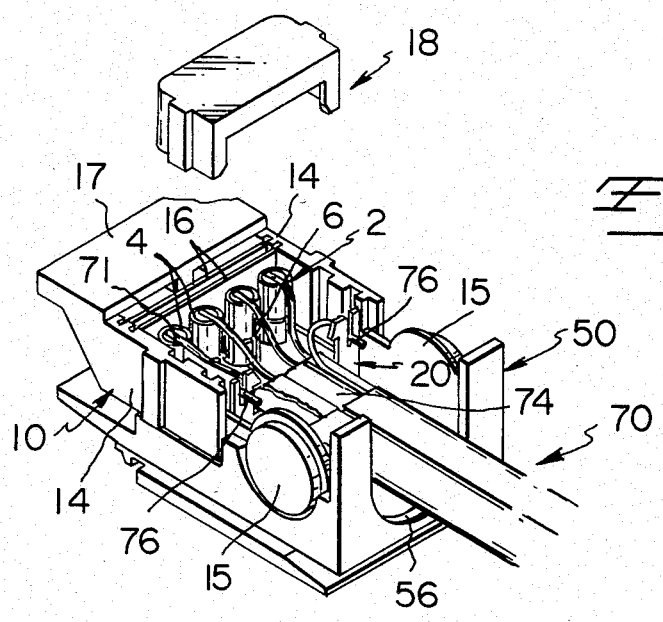
FIGS. 4A, 4B, and 4C are perspectives showing the termination of the stripped cable in the shielded connector.
Figure 5:
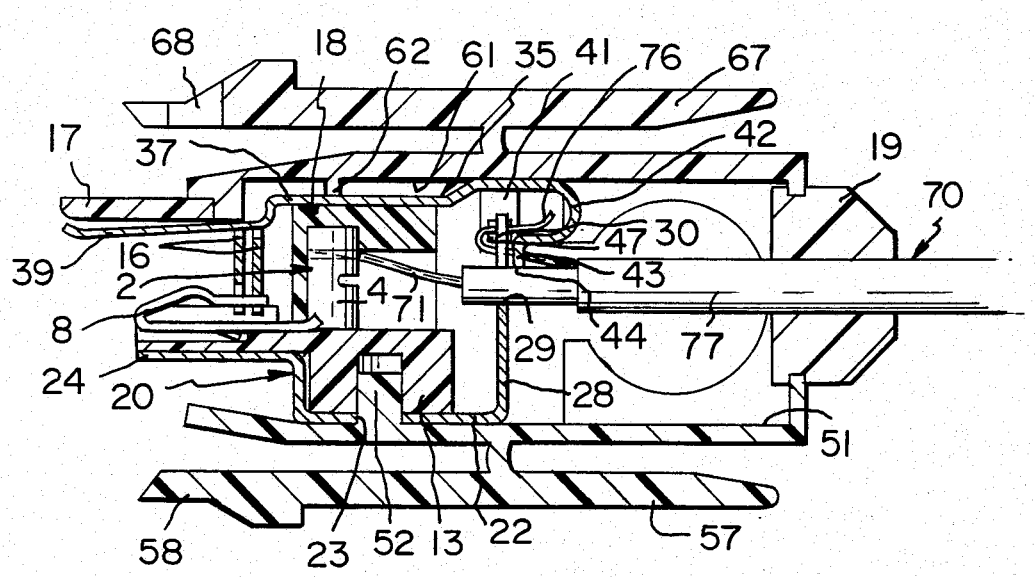
FIG. 5 is a cross section of the assembled connector.

FIG. 4A et seq illustrate the assembly sequence. FIG. 3A shows the bottom shield member 50 as assembled to terminal housing 10, with the panel 22 sandwiched between the housing 10 and bottom cover 50 (FIG. 5). Cable 70 is shown with signal conductors 71 poised for termination to terminals 2 and drain wires 76 terminated in tabs 30 which flank the exposed shields 74. Wire stuffer 18, which has four plug members profiled to fit in barrels 4, is shown poised to force the conductors 71 into slots 6 in the barrels 4. The stuffer 18 is ribbed for alignment between sidewalls 14 of the housing 10.

Figure 4B:
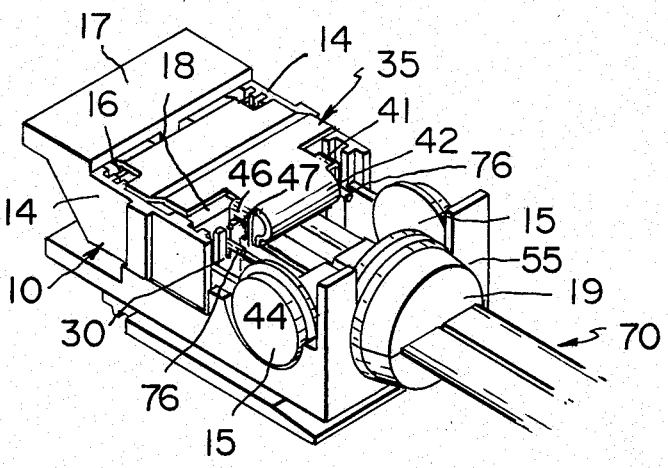
Figure 4C:
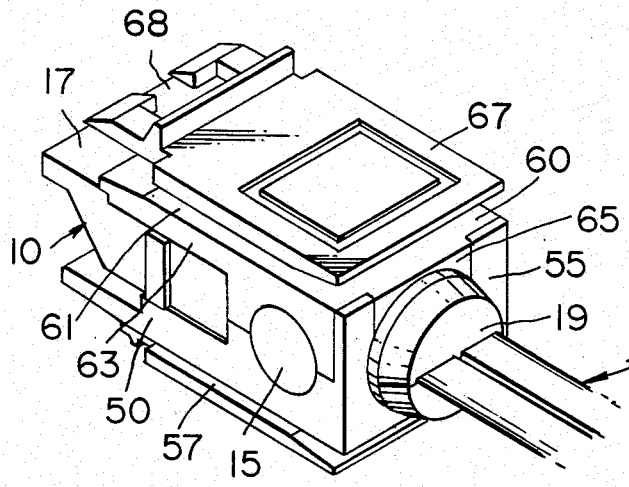

FIG. 4B shows the stuffer 18 and the top shield member 35 in place. The contact portion 39 (FIG. 1) is fit under platform 11 which bridges sidewalls 14, and tabs 46 are fit between tabs 30. During assembly of the top shield member 35 to the terminal housing 10, the tabs 46 flex inwardly until the detents 32 on tabs 30 snap into apertures 47 in tabs 46, thus locking the shielding members 20, 35 together. The reverse bend 42 provides resilience which causes the edge 44 of flange 43 to bear against the cable shields 74. After the shield member 35 is in place, the bushing 19 is fitted to the cable 70 in recess 54 of rear wall 55. The only remaining step is placing the top cover 60 as shown in FIG. 4C. Latching is provided as described in U.S. application Ser. No. 452,171. If a right angle termination is desired, one of the blanks 15 is removed prior to assembling the housing 10 to bottom cover 50, and the cable 70 is folded on a line at 45 degrees across its axis to exit through the hole formed by a pair of recesses 54, 64. A bushing 19 is used similarly and a plug as in application Ser. No. 452,171 is used in the rear walls 55, 65.

FIG. 5 is a cross-sectional view of the assembled connector with shielded cable 70 terminated thereto. Terminals 2 are in place in terminal housing 10 and signal conductors 71 are terminated in barrels 4 of the terminals 2, while drain wires 76 are terminated in tabs 30 of bottom shield member 20. The cable shield 74 is gripped between edge 24 of flange 28 of bottom shield member 20 and edge 44 on flange 43 of top shield member 35. The edge 44 bears resiliently against the shield 74 under the spring action of reverse bend 42, thereby providing positive grounding as well as strain relief, and further provides positive placement of the cable 70 while bushing 19 is placed in covers 50, 60 to grip the external insulation 77 to provide secondary strain relief. The bottom shield is positively located by studs 52 on base 5, and retained by sandwiching between the foot 13 of housing 10 and the base 51 of bottom cover 50. The top shield member 35 is positioned by mating the tabs 46 with tabs 30, and is also held down by locating rib 62 on base 61 of cover 60 bearing against panel 37 of shield member 35. Latch arms 57, 67 are depressed toward the rear of the connector to achieve mating of the T-bar 58 and T-slot 68 with the T-slot 68 and T-bar 58 respectively of a like hermaphroditic connector. The mating of contacts 8 with like contacts causes disengagement of shorting bars 16 therewith, as described in detail in U.S. application Ser. No. 452,171.

The foregoing description is exemplary and not intended to limit the scope of the claims which follow.

I claim:

1. An electrical connector for shielded multiconductor flat cable having a drain wire associated with the cable shield, said connector being of the type comprising an insulating housing having a mating face, an opposed conductor receiving face, a plurality of terminals in the housing with resilient contact portions toward the mating face and wire connecting portions toward the wire receiving face, and a connector shield having a cable gripping portion and a contact portion, characterized in that said connector is adapted for use with a flat multiconductor cable having a planar array of shielded signal conductors, said connector shield comprising a bottom shield member assembled to said connector before terminating said signal conductors and a top shield member assembled to said connector after terminating said signal conductors, each said shield member being stamped and formed from one piece with a panel substantially parallel to the cable, a contact portion at the end of the panel toward the mating face, and a cable gripping portion toward the conductor receiving face, said cable gripping portion comprising a flange extending obliquely of said panel and contacting the portion of said cable adjacent said flange, said shield members having cooperating latching means so that the top shield member can be latched to the bottom shield member with the connector shield substantially surrounding a flat cable with said portion of said cable sandwiched between the opposed flanges, said latching means on said bottom shield member comprising an upstanding tab adjacent said cable, said tab having a slot therein profiled to receive said drain wire.

2. An electrical connector as in claim 1 characterized in that said connector is adapted for use with a flat cable having two cable shields, each shield surrounding a group of conductors, each shield member having a drain wire associated therewith, said latching means on said bottom shield member comprising a pair of coplanar upstanding tabs adjacent said gripping portion on opposite sides of said cable, each said upstanding tab having a slot therein profiled to receive a drain wire, said latching means on said top shield member comprising a pair of depending tabs adjacent said gripping portion on opposite sides of said cable, said depending tabs lying in parallel planes which are perpendicular to the plane of said upstanding tabs on said bottom member and situated to latch therewith.

3. An electrical connector as in claim 1 characterized in that said grounding portion on at least one of said shielding members comprises a U-section where said member is reversely bent between said panel and said flange, whereby said flange bears resiliently against said portion of said cable adjacent said flange.

4. An electrical connector for shielded multiconductor flat cable having a drain wire associated with the cable shield, said connector being of the type comprising an insulating housing having a mating face, an opposed conductor receiving face, a plurality of conductors in the housing with resilient contact portions toward the mating face and wire connecting portions toward the wire receiving face, and a connector shield having a cable gripping portion, said connector being characterized in that said connector is adapted for use with a flat multiconductor cable having a planar array of shielded signal conductors and at least one drain wire, said connector shield comprising a pair of shield members each stamped and formed from sheet metal with a panel substantially parallel to the cable, a contact portion at the end of the panel toward the mating face and a cable gripping portion toward the conductor receiving face, each said cable gripping portion comprising a flange substantially normal to said panel, one of said shields having a pair of upstanding tabs coplanar with said flange and formed integrally therewith on opposite sides thereof, said upstanding tabs each having a slot therein for receiving a drain wire and a detent on the edge opposed from the other said tab, the other said shield having a pair of depending tabs adjacent said flange and formed in planes perpendicularly thereto on opposite sides thereof, each said depending tab having an aperture profiled to receive a detent on an upstanding tab on the other said shield member, said upstanding and depending tabs being situated for latching with said cable sandwiched between said flanges.

* * * * *